United States Patent [19]

Nakase et al.

[11] Patent Number: 4,850,908

[45] Date of Patent: Jul. 25, 1989

[54] DRAWING AWAY DEVICE OF BILGE WATER FOR WATER JET PROPULSION

[75] Inventors: Ryoichi Nakase; Seiji Inoue, both of Shizuoka, Japan

[73] Assignee: Sanshin Kogyo Kabushiki Kaisha, Hamamatsu, Japan

[21] Appl. No.: 165,533

[22] Filed: Mar. 8, 1988

[30] Foreign Application Priority Data

Mar. 10, 1987 [JP] Japan ..... 62-54818

[51] Int. Cl.[4] ..... B63H 11/00

[52] U.S. Cl. ..... 440/39; 114/183 R; 114/270

[58] Field of Search ..... 114/183 R, 183 A, 184, 114/185, 270; 440/38, 39, 42, 88

[56] References Cited

U.S. PATENT DOCUMENTS

| | | | |
|---|---|---|---|
| 2,866,431 | 12/1958 | Conover | 114/185 |
| 3,273,333 | 9/1966 | Roulund | 114/184 |
| 4,667,616 | 5/1987 | Mahon | 114/183 R |
| 4,699,596 | 10/1987 | Klinker et al. | 440/39 |

*Primary Examiner*—Joseph F. Peters, Jr.
*Assistant Examiner*—Jesûs D. Sotelo
*Attorney, Agent, or Firm*—Ernest A. Beutler

[57] ABSTRACT

A number of embodiments of the invention wherein bilge water is discharged by means of a venturi pump and the discharge is upwardly directed externally of the watercraft to provide a spray that will indicate the watercraft location.

8 Claims, 4 Drawing Sheets

DRAWING AWAY DEVICE OF BILGE WATER FOR WATER JET PROPULSION

BACKGROUND OF THE INVENTION

This invention relates to a device for drawing away bilge water from a jet propulsion unit and more particularly to an improved arrangement for drawing bilge water from a watercraft and providing a signal indicative of the watercraft position through the discharge of the bilge water.

It is well known that water tends to accumulate in the bilge of a watercraft. Unless this bilge water is removed, obvious problems can occur. This problem is particularly acute with a small type of watercraft that is designed to be operated primarily by a single rider wearing a swimming suit and which watercraft may, at times, become at least partially submerged.

Such small watercraft, in addition to the problem of bilge water removal, also have another consideration. Because of their small size, it is difficult for such watercraft to be visible from great distances. This problem is particularly acute when the small watercraft is powered by a jet propulsion type of unit because the water discharge from the jet propulsion unit itself does not provide a visible signal as is the case with normal propeller driven watercraft.

It is, therefore, a principal object of this invention to provide an improved arrangement for removing bilge water from such a small watercraft.

It is yet a further object of this invention to provide an arrangement for not only removing bilge water from a small watercraft but doing so in such a way as to provide a visual signal of the watercraft location.

It is a still further object of this invention to provide an improved bilge water removal system for a small watercraft wherein the removal system also provides a visual indication of the watercraft location.

SUMMARY OF THE INVENTION

This invention is adapted to be embodied in a small watercraft having a hull that defines a bilge area in which water may accumulate. Pumping means are provided for pumping water from the body of water in which the watercraft is operating through a conduit in which a venturi pump is located. Bilge water conduit means extends from the bilge area to the venturi pumping means for drawing bilge water from the bilge into the conduit. The conduit terminates in a discharge nozzle that extends upwardly so as to provide an upwardly directed water spray that will give an indication of the watercraft location.

In accordance with another feature of the invention, the watercraft is powered by a jet propulsion unit and the pressure discharge of the jet propulsion unit is used as the pumping means for pumping the water.

DETAILED DESCRIPTION OF THE PREFERRED EMBODIMENTS OF THE INVENTION

Figure 1:
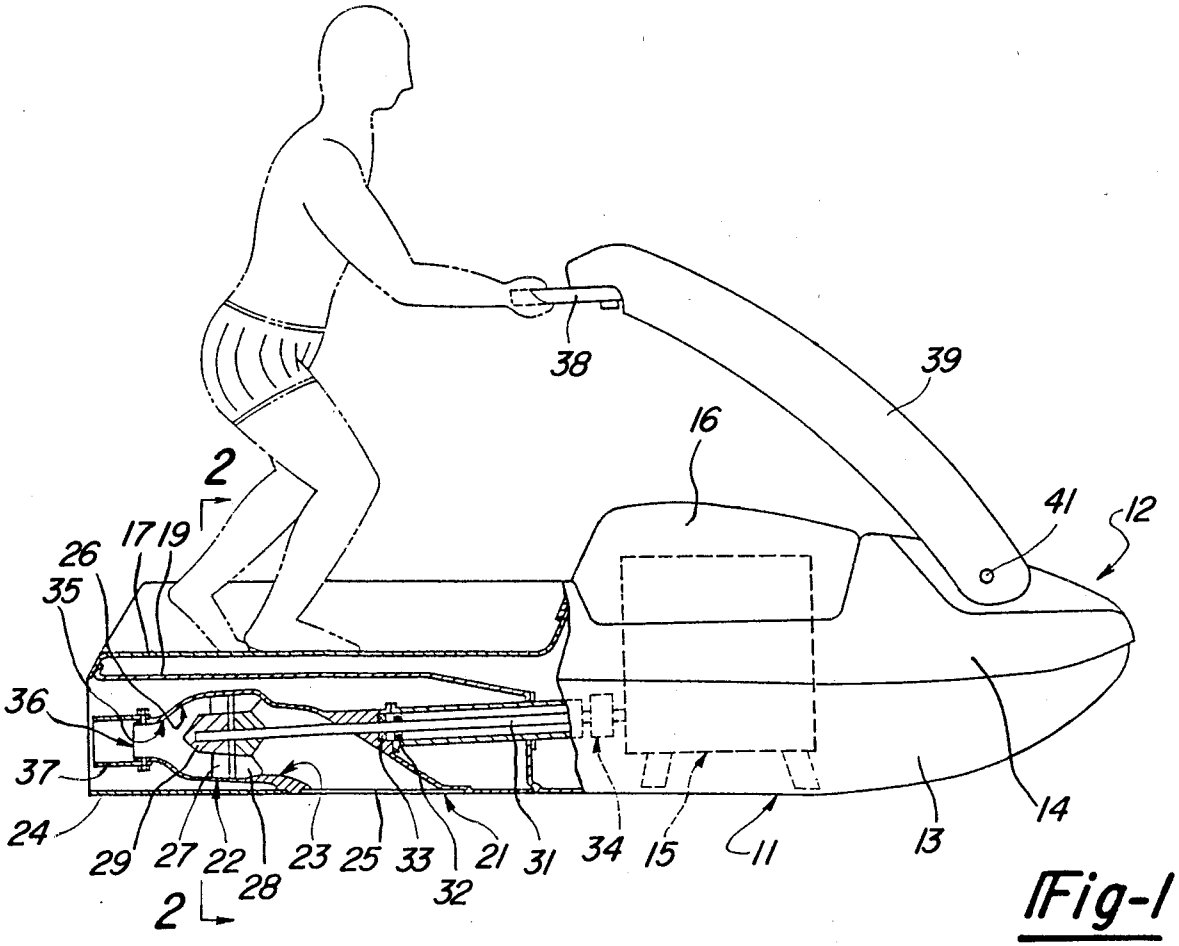
FIG. 1 is a side elevational view, with a portion broken away, of a small watercraft constructed in accordance with an embodiment of the invention and which forms a typical environment in which the invention may be employed.
Figure 2:
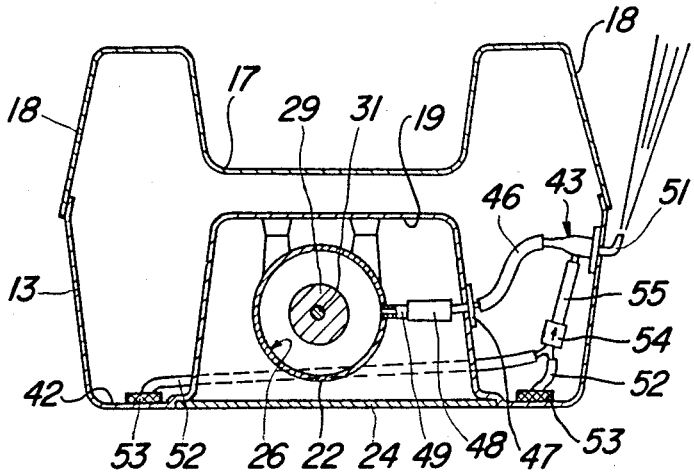
FIG. 2 is a cross-sectional view taken along the line 2—2 of FIG. 1 and shows the bilge water removal system.
Figure 3:
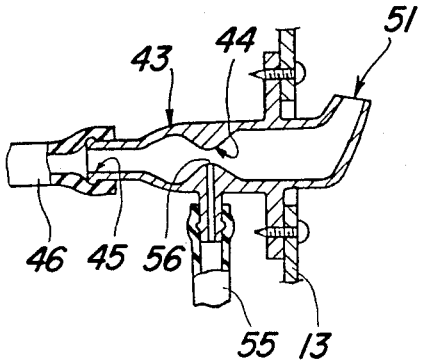
FIG. 3 is an enlarged cross-sectional view showing the venturi pumping system.

Referring now in detail to the drawings and initially to the embodiment of FIGS. 1 through 3 and primarily to FIG. 1, a small watercraft constructed in accordance with a first embodiment of the invention is identified generally by the reference numeral 11. The small watercraft 11 is of the type that is designed to be operated by a single rider dressed in a swimming suit, due to the sporting nature of the watercraft 11. It is to be understood, however, that facets of the invention can be employed in connection with other types of watercraft.

The small watercraft 11 is comprised of a hull, indicated generally by the reference numeral 12, and comprised of a lower portion 13 and an upper or deck portion 14. The portions 13 and 14 are formed from a suitable material such as moulded fiberglass and may be permanently connected to each other in a suitable manner. The forward portion of the lower hull part 13 and the deck 14 define an engine compartment in which an internal combustion engine of any suitable type 15 is provided. The engine compartment is enclosed by a removable hatch cover 16 for affording access to the engine 15 for servicing.

A rider's area 17 is formed rearwardly of the engine compartment and specifically the hatch cover 16 and is designed so as to accommodate a single rider in either a standing, kneeling or seated position. The rider's area 17 is defined between a pair of raised gunnels 18 formed by the deck portion 14.

To the rear of the engine compartment and positioned beneath the rider's area is a tunnel 19 that is adapted to contain a jet propulsion unit, indicated generally by the reference numeral 21. The jet propulsion unit 21 includes an outer housing 22 that defines at its forward end a water inlet opening 23. A blanking plate 24 is supported across the lower end of the tunnel 19 and has a corresponding opening 25 through which water may flow to the jet propulsion unit 21.

The outer housing 22 further defines an impeller cavity 26 in which an impeller 28 is supported for rotation. The impeller 28 is disposed downstream of fixed straightening vanes 27 that are positioned within the impeller cavity 26. The impeller 28 has a hub portion 29 that is affixed to the rear end of a drive shaft 31. The drive shaft 31 extends forwardly through a tubular member 32 wherein it is supported by bearings and a seal 33. The forward end of the drive shaft 31 is connected by means of a coupling member 34 to the engine output shaft for driving the impeller.

The water which has been moved by the impeller blades 28 is discharged through a fixed discharge opening 35 that has a discharge end 36 that opens into a jet discharge nozzle 37. The nozzle 37 is journaled for steering movement about a generally vertically extending axis and may be steered by means of a handlebar assembly 38 that is carried at the rearward end of a pivotal mast 39 for steering of the watercraft 11 by the operator. The mast assembly 39 is pivotally connected to the hull 12 by means of a pivot pin 41 so as to accommodate the riding position of the rider.

The construction of the watercraft as thus far described may be considered to be conventional. For that reason, details of the construction of the components as thus far described are not necessary to understand the invention. In accordance with the invention, however, there is provided a pumping system for discharging water that may collect within the hull 13 and specifically within a bilge area, indicated generally by the reference numeral 42 and discharging it back into the body of water in which the watercraft is operating.

This bilge water pumping system includes a venturi type pumping device 43 that is affixed to a side of the hull lower portion 13 outwardly of the tunnel 19. The venturi pumping device 43 has a venturi section 44 (FIG. 3) that is downstream of an inlet nipple 45. A conduit 46 interconnects this inlet nipple 45 with a fitting 47 that is formed in the wall of the hull which defines the tunnel 19. A further flexible conduit 48 interconnects the fitting 47 with a fitting 49 that is disposed on the downstream side of the impeller 28 so as to receive pressurized water and transmit it through the conduits 48 and 46 to the venturi pumping device 43. This water is discharged upwardly through a discharge nozzle 51 provided at the side of the hull 13 in a location so that the upward water spray will be visible from a distance. As a result, this provides a warning indicator for the watercraft 11.

Bilge water is collected from the bilge 42 through a pair of pick-up conduits 52 that are disposed on opposite sides of the tunnel 19 in an area where bilge water will collect. Strainers 53 are provided over the ends of the bilge water pick-ups so as to prevent the induction of foreign matter. The conduits 52 merge at a one-way check valve 54 that prevents reverse flow and which discharges through a conduit 55. The conduit 55 terminates at a nipple 56 that is formed in the venturi section 44. As a result, the water flow through the venturi section caused by the pumping of the impeller 28 will create a reduced pressure at the nipple 56 that will cause bilge water to be drawn upwardly and discharged through the discharge nozzle 51. As a result, the pumping device provides not only an indicator but also a bilge water removal system.

Figure 4:
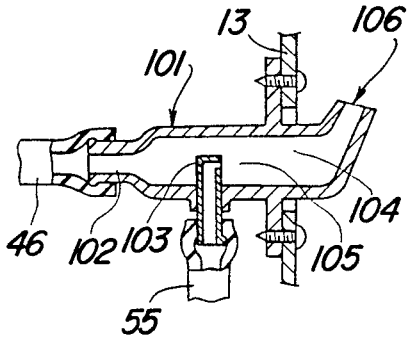
FIG. 4 is a cross-sectional view, in part similar to FIG. 3, showing another embodiment of the invention.

FIG. 4 shows another embodiment of the invention which is generally similar to the embodiment of FIGS. 1 through 3. In this embodiment, a pumping device indicated generally by the reference numeral 101 has an inlet fitting 102 that receives pressurized water from the jet drive unit through the flexible conduit 46. However, rather than a venturi section, the pumping device 101 includes a pumping nozzle 103 that extends into the interior chamber 104 of the pumping device 101 and which has an outlet opening 105 that faces toward the discharge end. As a result, water flowing through the pumping device 101 will cause a reduced pressure at the outlet 105 that causes bilge water to be drawn through the conduit 55 and the other conduits which may have the form as shown in FIG. 2. This bilge water is discharged through an upwardly spraying nozzle 106 along with the water pumped by the venturi action so as to provide an indicator function, as with the embodiment of FIGS. 1 through 3.

Figure 5:
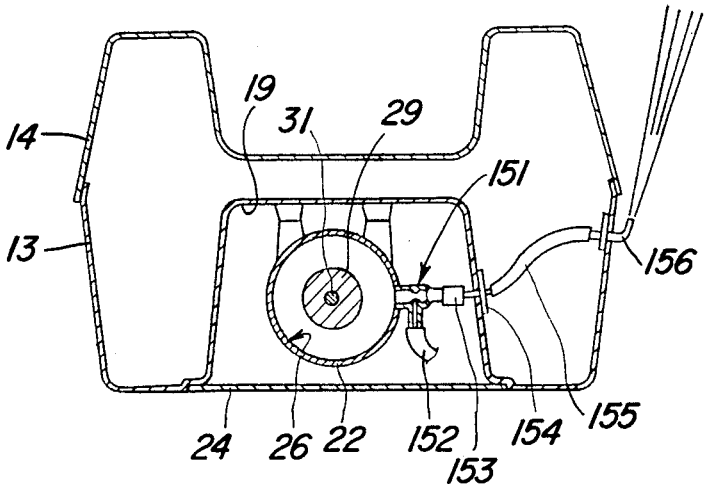
FIG. 5 is a cross-sectional view, in part similar to FIG. 2, showing yet another embodiment of the invention.

FIG. 5 shows another embodiment of the invention which is generally similar to the previously described embodiments and which may embody a pumping device, indicated generally by the reference numeral 151 which may be of the type shown in either FIG. 3 or FIG. 4. In this embodiment, however, the pumping device 151 is located directly within the tunnel 19 and hence simplifies the plumbing from the jet drive unit 22 to the pumping device 151 which it powers. Like the previously described embodiments, conduits 152 extend to the bilge for drawing the bilge water and this bilge water is discharged along with the water delivered by the jet drive unit 22 through a pipe 153 that communicates with a fitting 154 in the wall that defines the tunnel 19. A conduit 155 delivers water from this fitting to an upwardly facing discharge nozzle 156 so as to provide an indicator spray as in the previously described embodiments.

Figure 6:
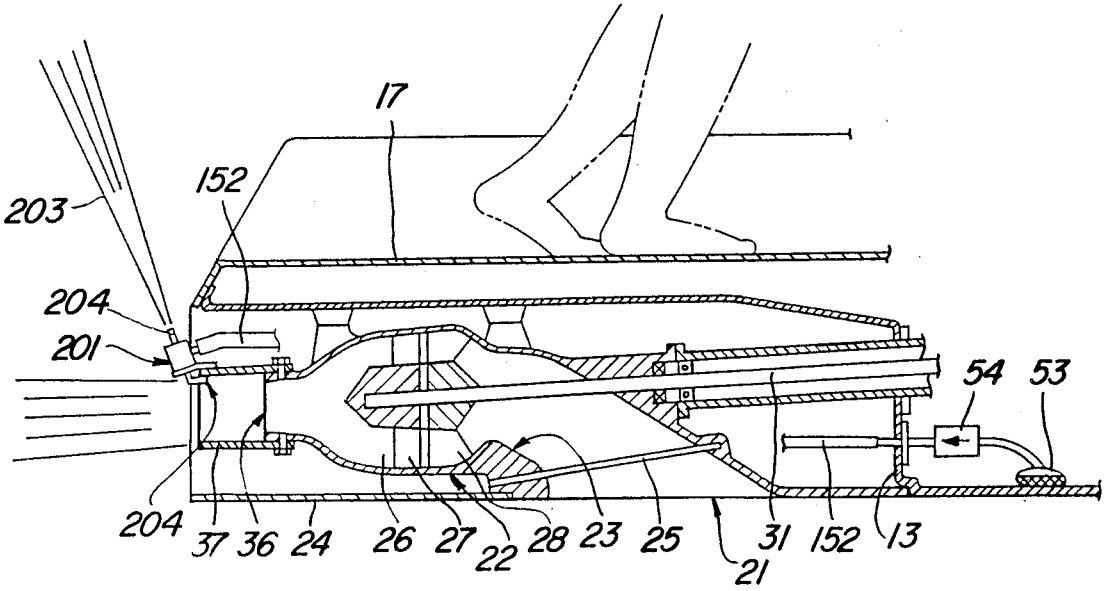
FIG. 6 is a partial side elevational view, in part similar to FIG. 1, showing a still further embodiment of the invention.

FIG. 6 shows another embodiment of the invention which is generally similar to the previously described embodiments. In this embodiment, however, a pumping unit 201 is mounted directly in the steering discharge nozzle 37 of the jet drive unit so that it will follow rotation of the steering nozzle. A forwardly facing inlet 202 receives pressurized water and operates the pumping unit 201 as in the previously described embodiments. This pumping unit 201 may be of a construction as shown in either FIG. 3 or in FIG. 4 and discharges a water spray 203 through an upwardly facing discharge nozzle 204 at the end of the jet drive steering nozzle 37. As a result, the device will operate like the previously described embodiments and provide the dual function of removing bilge water and also providing an indicator spray.

Figure 7:
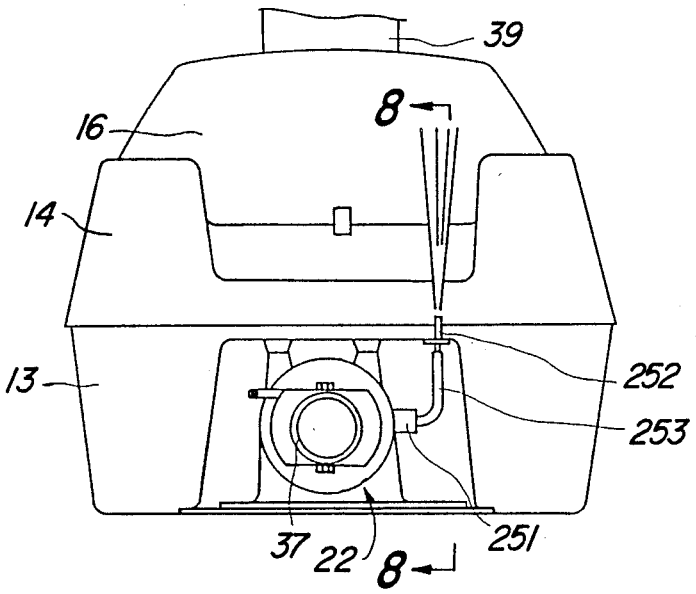
FIG. 7 is a rear elevational view showing a small watercraft constructed in accordance with yet another embodiment of the invention.
Figure 8:
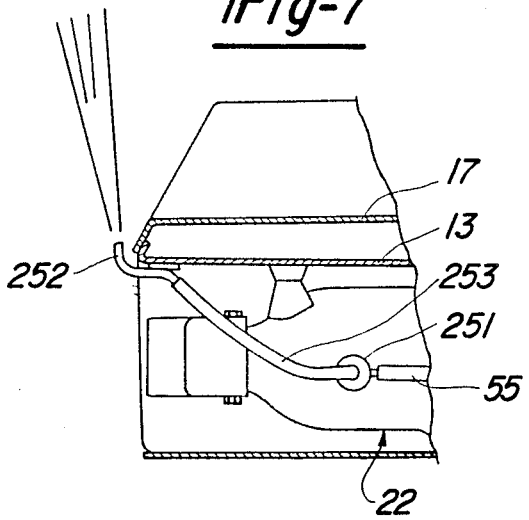
FIG. 8 is a cross-sectional view taken along the line 8—8 of FIG. 7.

FIGS. 7 and 8 show another embodiment of the invention wherein a pumping device 251, which may be of the type as shown in either FIG. 3 or FIG. 4, is located adjacent the jet drive unit discharge section as shown in FIG. 5. However, in this embodiment an upwardly facing discharge nozzle 252 is positioned at the rear of the hull so as to spray upwardly in this area to discharge the bilge water and to provide an indicator. In all other regards, this embodiment is the same as the previously described embodiments and, for that reason, components which are the same as those previously described have been identified by the same reference numerals and will not be described again. A conduit 253 interconnects the pumping unit 251 with the discharge nozzle 252.

In each of the embodiments the means for delivering water under pressure to the venturi pumping device for drawing bilge water has comprised the jet drive unit. It is to be understood that a separate pump may be utilized for this purpose. However, the use of the jet drive pump for this purpose greatly simplifies the construction and reduces its cost.

It should be readily apparent from the foregoing description that a number of embodiments of the invention have been illustrated and described and each of which provides a very effective way for discharging bilge water from a water craft and which also is effective to provide a signal indicative of the watercraft location. Although a number of embodiments of the invention have been illustrated and described, various changes and modifications may be made without departing from the spirit and scope of the invention, as defined by the appended claims.

We claim:

1. In a small watercraft having a hull defining a bilge area in which water may accumulate, pumping means for pumping water from the body of water in which said watercraft is operating through a conduit, venturi pumping means in said conduit, bilge water conduit means extending from said bilge area to said venturi pumping means for conveying bilge water from said bilge area to said venturi pumping means, and an upwardly discharging spray nozzle for receiving pumped water and bilge water from said venturi pumping means and discharging it upwardly to provide a signal indicative of the position of the watercraft.

2. In a small watercraft as set forth in claim 1 wherein the watercraft is powered by a jet propulsion unit.

3. In a small watercraft as set forth in claim 2 wherein the means for pumping water comprises the jet propulsion unit.

4. In a small watercraft having a hull defining a bilge area as set forth in claim 3 wherein the spray nozzle discharges water other than through the jet propulsion unit.

5. In a small watercraft having a hull defining a bilge area in which water may accumulate, said watercraft being propelled by a jet propulsion unit comprising pumping means for pumping water from the body of water in which said watercraft is operating through a steering nozzle, a conduit having an inlet end, communicating with said jet propulsion unit for receiving water pressurized thereby, venturi pumping means in said conduit, bilge water conduit means extending from said bilge area to said venturi pumping means for conveying bilge water from said bilge area to said venturi pumping means, and an upwardly discharging spray nozzle for receiving pumped water and bilge water from said venturi pumping means and discharging it upwardly to provide a signal indicative of the position of the watercraft, said spray nozzle discharging through a side of said hull.

6. In a small watercraft having a hull defining a bilge area in which water may accumulate, said watercraft being propelled by a jet propulsion unit comprising pumping means for pumping water from the body of water in which said watercraft is operating through a steering nozzle, a conduit having an inlet end communicating with said jet propulsion unit for receiving water pressurized thereby, venturi pumping means in said conduit, bilge water conduit means extending from said bilge area to said venturi pumping means, and an upwardly discharging spray nozzle for receiving pumped water and bilge water from said venturi pumping means and discharging it upwardly to provide a signal indicative of the position of the watercraft, said discharge nozzle sprays at the rear of said hull.

7. In a small watercraft having a hull defining a bilge area in which water may accumulate, said watercraft being propelled by a jet propulsion unit comprising pumping means for pumping water from the body of water in which said watercraft is operating through a steering nozzle, a conduit having an inlet end communicating with said jet propulsion unit for receiving water pressurized thereby, venturi pumping means in said conduit, bilge water conduit means extending from said bilge area to said venturi pumping means, and an upwardly discharging spray nozzle for receiving pumped water and bilge water from said venturi pumping means and discharging it upwardly to provide a signal indicative of the position of the watercraft, said venturi pumping means being carried by said steering nozzle of said jet propulsion unit.

8. In a small watercraft having a hull defining a bilge area as set forth in claim 7 wherein the venturi pumping means has an inlet opening in communication with the steering nozzle for forming the conduit inlet end.

* * * * *